United States Patent [19]
Levi
[11] 4,317,744
[45] Mar. 2, 1982

[54] CORROSION INHIBITOR

[75] Inventor: Elliott J. Levi, Kinnelon, N.J.
[73] Assignee: Drew Chemical Corporation, Boonton, N.J.

[21] Appl. No.: 33,122
[22] Filed: Apr. 25, 1979
[51] Int. Cl.³ ..... C09K 3/00
[52] U.S. Cl. ..... 252/389 A; 210/749; 252/390; 422/15; 422/16; 422/17; 106/14.05; 106/14.16; 106/14.13; 106/14.12
[58] Field of Search ..... 252/389 A, 390, 148, 252/8.55 E, 180, 392; 210/58, 59; 422/15-19; 106/14.05, 14.12, 14.16, 14.13

[56] References Cited

U.S. PATENT DOCUMENTS

| | | | |
|---|---|---|---|
| 3,699,048 | 10/1972 | Krueger et al. | 252/180 |
| 3,716,569 | 10/1968 | Gaupp | 528/30 |
| 3,764,804 | 7/1972 | Redmore | 252/8.55 E |
| 3,891,568 | 6/1975 | Nishio et al. | 252/389 A |
| 3,941,562 | 3/1976 | Hollingshad | 252/389 A |
| 3,992,318 | 11/1976 | Gaupp et al. | 252/389 A |
| 4,076,501 | 2/1978 | Hanis et al. | 252/389 A |
| 4,101,441 | 7/1978 | Hwa et al. | 252/389 A |
| 4,105,581 | 8/1978 | Sexsmith | 252/389 A |
| 4,130,524 | 12/1978 | Boerwinkle et al. | 252/389 A |
| 4,134,959 | 1/1979 | Menke et al. | 252/389 A |
| 4,138,353 | 2/1979 | Lipinski | 252/389 A |
| 4,149,969 | 4/1979 | Robitaille et al. | 252/389 A |
| 4,176,059 | 11/1979 | Suzuki | 252/389 A |
| 4,202,796 | 5/1980 | Jacobs et al. | 106/14.16 |

*Primary Examiner*—Benjamin R. Padgett
*Assistant Examiner*—J. L. Barr
*Attorney, Agent, or Firm*—Louis E. Marn; Elliot M. Olstein

[57] ABSTRACT

Corrosion inhibitor comprised of corrosion inhibiting amounts of a water soluble phosphonic acid or salt thereof; polymer of acrylic, methacrylic, maleic acid or its anhydride; and tolyltriazole. The corrosion inhibitor is particularly employed for inhibiting corrosion of ferrous containing metal; e.g., mild steel employed in cooling water systems.

15 Claims, No Drawings

CORROSION INHIBITOR

This invention relates to corrosion inhibition, and more particularly, to a new and improved corrosion inhibiting composition which is particularly suitable for aqueous systems.

U.S. Pat. No. 3,992,318, and U.S. Pat. No. 4,105,581 disclose three component corrosion inhibiting compositions, with the former being comprised of a phosphonate, phosphate and polymer of acrylic or methacrylic acid, and the latter being comprised of a phosphonate, phosphate and polymer of maleic acid or its anhydride.

Although such compositions are effective corrosion inhibitors, each of such compositions includes phosphates, and in some cases, for environmental reasons, the presence of phosphates should be avoided.

The present invention is directed to providing a new and improved corrosion inhibiting composition, which does not require the presence of a phosphate.

In accordance with the present invention, there is provided a corrosion inhibiting composition which includes corrosion inhibiting amounts of the following components:

a. at least one water soluble phosphonic acid or salt thereof;

b. at least one water soluble polymer of acrylic acid, methacrylic acid or maleic acid or its anhydride; and c. tolyltriazole.

As used herein the term "water soluble" means that the compound is soluble in the amount required for corrosion inhibition. Accordingly, the compound can be sparingly soluble in water so long as the compound is sufficiently water soluble to provide, in solution, a corrosion inhibiting amount thereof.

The term "corrosion inhibiting amount" as used herein means that the component is present in an amount such that the composition inhibits corrosion and maintains such corrosion inhibition in an aqueous system.

The phosphonic acid or salt thereof component of the present invention is a compound characterized by the following group:

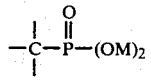

wherein each M is independently either hydrogen or a cation; e.g., a metal ion, including alkali metals, such as sodium, lithium, and potassium, alkaline earth metals, such as calcium and magnesium, aluminum, zinc, cadmium, and manganese; nickel, cobalt, cerium; lead, tin; iron, chromium and mercury; an ammonium ion; or an alkyl ammonium ion derived from amines having a low molecular weight, such as below 300, and more particularly, the alkyl amines, alkylene amines and alkanol amines containing no more than two amine groups, such as ethyl amine, diethyl amine, propyl-amine, propylene diamine, hexyl amine, 2-ethylhexylamine, N-butylethanol amine, triethanol amine and the like.

It is to be understood that as used herein the term "phosphonic acid" generically includes the phosphonic acid and the salts thereof.

As one type of phosphonic acid suitable for the purposes of the present invention, there may be mentioned the aminomethylene phosphonic acids which are characterized by the following grouping:

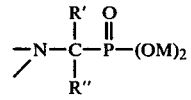

wherein M is as hereinabove defined and R′ and R″ are each individually hydrogen or hydrocarbon (preferably $C_1$–$C_5$ alkyl).

The aminomethylene phosphonic acids are preferably characterized by the following structural formula:

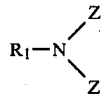

wherein Z is

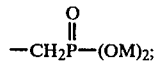

and $R_1$ is

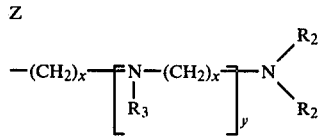

(a)
(b)

wherein each $R_2$ is independently either Z, hydrogen,

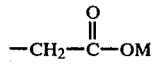

or $CH_2$ $CH_2$ OH and $R_3$ is either hydrogen, Z or $C_1$–$C_{20}$ Alkyl.

x is 1 to 20 y is 0 to 18 and total of x+y is no more than 20.

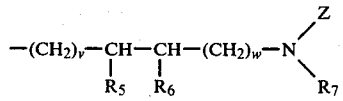

(c)

wherein $R_5$ is hydrogen or hydroxyl;

$R_6$ is hydrogen or alkyl, preferably an alkyl group containing 1 to 6 carbon atoms and $R_5$ and $R_6$ together with the two carbon atoms to which they are attached can form a cycloalkyl ring, preferably having from 4 to 6 carbon atoms.

v is 0 to 20;

w is 0 to 20, and the total of v+w is no more than 20;

$R_7$ is hydrogen or Z;

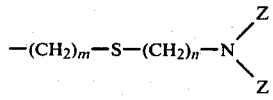

(d)

wherein m and n are each 1 to 3.

$$-R_8(OR_9)_4(OR_{10}) \quad (e)$$

wherein $R_8$ is $C_3$—$C_5$ alkylene $R_9$ is $C_2$—$C_5$ alkylene $R_{10}$ is $C_1$—$C_5$ alkyl r is 1 to 20.

As a further type of aminomethylene phosphonic acid, there may be mentioned the silicon containing amino methylene phosphonic acids, as described in U.S. Pat. No. 3,716,569 which is hereby incorporated by reference.

As still another type of aminomethylene phosphonic acid, there may be mentioned the nitrogen-heterocyclic phosphonic acids characterized by aminomethylene phosphonic acids bonded directly or indirectly to the nitrogen atom of the heterocyclic ring, as disclosed in U.S. Pat. No. 3,674,804 which is hereby incorporated by reference.

As still another type of phosphonic acid which is suitable for the purposes of the present invention, there may be mentioned the ethane diphosphonic acids. The ethane diphosphonic acids are characterized by the following structural formula:

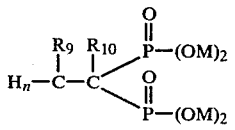

wherein

M is as defined previously; n is 1 or 2 to provide the required number of hydrogen atoms;

$R_9$ is either hydrogen, alkyl (preferably containing 1 to 4 carbon atoms), oxygen, halogen, hydroxy, cyano, $-N(R_{11})_2$ wherein $R_{11}$ is hydrogen or alkyl containing 1–30 carbon atoms; $XR_{12}$ wherein X is sulfur or oxygen and $R_{12}$ is alkyl containing 1–30 carbon atoms, preferably 1–4 carbon atoms; phenyl; benzyl; acetoxy; $SO_3R_{11}$ wherein $R_{11}$ is as above; benzoyl; $CO_2H$ and $CH(COOR_{11})_2$ wherein $R_{11}$ is as defined above;

$R_{10}$ is as above except for oxygen and alkyl, and $R_{10}$ is hydrogen when $R_9$ is oxygen;

and one of $R_9$ and $R_{10}$ is hydroxy, except that when $R_9$ is oxygen $R_{10}$ is hydrogen.

The ethane diphosphonic acids are disclosed in U.S. Pat. No. 3,644,151 which is hereby incorporated by reference.

As representative examples of phosphonic acids which are preferably employed in the corrosion inhibiting composition of the present invention, there may be mentioned:

ethane-1-hydroxy-1, 1-diphosphonic acid, amino tri (methylene phosphonic acid), ethylene diamine tetra (methylene phosphonic acid), hexamethylene diamine tetra (methylene phosphonic acid); and the water soluble salts thereof.

Another component of the composition is a water soluble polymer of acrylic acid, methacrylic acid or maleic acid or its anhydride, and the term "polymer", as used herein, includes both homopolymers and copolymers, with the term "copolymer" including copolymers formed from two or more monomers and also including random, block, and graft copolymers.

As representative examples of polymers of maleic acid or its anhydride, acrylic acid and methacrylic acid, there may be mentioned: the homopolymer of acrylic acid; the homopolymer of methacrylic acid; the homopolymer of maleic acid or its anhydride; the copolymer of acrylic acid and methacrylic acid; a copolymer of acrylic and/or methacrylic acid with other polymerizable ethylenically unsaturated monomers, such as, crotonic acid, maleic acid or its anhydride, vinyl sulfonic acid, vinyl phosphonic acid, vinyl acetate, ethyl vinyl ether, acrylamide, ethyl acrylate, ethyl methacrylate, methacrylonitrile; graft polymers of a polysaccaride as potato starch, corn starch, and other starches, starch ethers, water soluble cellulose ethers, modified starches obtained by treating starch with acids or with oxidizing agents at a temperature below the gelatinization temperature, or starch degradation products which are soluble in cold water and are obtained by treating an aqueous starch suspension with an oxidizing agent at a temperature up to 100° C., or dextrins produced, for instance by treating starch with acids followed by heating to a temperature above 150° C., or by roasting starch at 180°–200° C. Such polymers are described in U.S. Pat. No. 3,699,048 and British Pat. No. 1,234,320 which are hereby incorporated by reference. The polymer generally has a number average molecular weight of at least 300, most generally from 500 to 20,000; however, higher molecular weight polymers can be employed provided that the polymer is water soluble. The preferred polymer is a homopolymer of maleic acid or its anhydride.

A third component of the composition is tolyltriazole. Applicant has found that in the corrosion inhibiting composition of the present invention, tolyltriazole gives unexpectedly superior results.

The three components of the composition of the present invention are incorporated therein in corrosion inhibiting amounts; i.e., the three components are present in the composition in an amount which is effective to prevent corrosion upon addition of the composition to a system subject to corrosion. In general, the composition includes from about 65 to about 80% of the phosphonate, from about 5 to about 20% of the polymer and from about 15 to about 25% of the triazole, based on the three components, all by weight. It is to be understood that although the hereinabove described amounts of the components employed in the composition are preferred, the overall scope of the invention is not limited to such amounts. The choice of optimum amounts of the various components is deemed to be within the scope of those skilled in the art from the teachings herein.

The composition of the present invention, including the hereinabove described three components, is generally employed in combination with a liquid vehicle, preferably water. It is to be understood, however, that the composition can also be employed in solid form, or that the components can be individually added to the aqueous system. In general, the composition is employed using water as a vehicle, with the components being added to the water to provide a concentration of the three components in the water of from about 1 to about 80%, and preferably from about 5 to about 40%, all by weight. The composition may also include other water treatment components, such as, defoamers, dispersants, biocides, etc. and accordingly, the addition of such components is within the scope of the present invention.

The composition of the present invention containing corrosion inhibiting amounts of the hereinabove described three components is added to a system subject to corrosion in a corrosion inhibiting amount; i.e., in an amount which is effective to prevent corrosion in the system. This amount will vary depending upon the system to which the composition is added and is influenced by factors, such as area subject to corrosion, processing conditions (pH, temperature, water quantity, etc.). In general, the corrosion inhibitor is employed in the system in an amount to provide a concentration of the three components of at least 1 ppm and preferably at least 5 ppm. In most cases, the concentration of the three active components does not exceed 100 ppm, all by weight. The selection of optimum amounts of the three components for providing the desired corrosion inhibition is deemed to be well within the scope of those skilled in the art from the teachings herein.

The composition of the present invention is particularly suitable for inhibiting corrosion in aqueous systems. The corrosion inhibitor of the present invention is particularly effective for inhibiting corrosion of ferrous containing metals, and in particular, mild steel. Such mild steel is generally employed in cooling water systems, and as a result, the corrosion inhibitor of the present invention has particular applicability to inhibiting corrosion in such cooling water systems.

As hereinabove noted, the triazole component is tolyltriazole, and the polymer component is preferably a homopolymer of maleic acid or maleic anhydride. As a result, the preferred compositions of the present invention are comprised of tolyltriazole, a homopolymer of maleic acid or maleic anhydride, and a phosphonate, in particular one of the hereinabove referred to preferred phosphonates, with ethane-1-hydroxy-1, 1-diphosphonic acid, or a water soluble salt thereof being particularly preferred.

The present invention will be further described with respect to the following examples, but it is to be understood that the scope of the invention is not to be limited thereby. Unless otherwise specified, all parts and percentages are by weight.

EXAMPLES

The following compositions were tested in a standard hard water (SHW) ($Ca^{++}$ 120 ppm; $Mg^{++}$ 24 ppm; $HCO_3^-$ 24 ppm; $SO_4^=$ 500 ppm; $Cl^-$ 500 ppm) to test corrosion inhibition with mild steel specimens

| | A | B |
|---|---|---|
| Ethane-1-hydroxy-1,1-diphosphonic Acid | 11.0% | 11.0% |
| Poly Maleic Anhydride | 1.7% | 1.7% |
| Benzotriazole | 1.75% | — |
| Tolyltriazole | — | 1.75% |
| KoH (45%) | 21.7% | 21.7% |
| KELIG 32 (40%) (a lignosulfonate) | 10.7% | 10.7% |
| Water | 53.15% | 53.15% |

Composition A, which includes benzotriazole, is a prior art composition, whereas composition B, which includes tolyltriazole as a replacement for benzotriazole is in accordance with the invention.

| | Treatment Level (ppm) | | | | Avg. Corrosion Rate |
|---|---|---|---|---|---|
| | 24 hrs. | 48 hrs. | Water | pH | Mild Steel |
| 1. Composition A | 300 | 150 | SHW | 7.0–7.5 | 13.6 |
| 2. Composition A | 300 | 150 | SHW 180 ppm $NaHCO_3$ | 8.0–8.5 | 7.1 |

-continued

| | Treatment Level (ppm) | | | | Avg. Corrosion Rate |
|---|---|---|---|---|---|
| | 24 hrs. | 48 hrs. | Water | pH | Mild Steel |
| 3. Composition B | 300 | 150 | SHW | 7.0–7.5 | 9.6 |
| 4. Composition B | 300 | 150 | SHW 180 ppm $NaHCO_3$ | 8.0–8.5 | 3.6 |

The above examples show the superiority of the composition of the present invention (Examples 3 and 4) as compared to the prior art composition (Examples 1 and 2).

The present invention is particularly advantageous in that corrosion inhibition can be provided without the use of phosphates. In addition, the use of tolyltriazole, as compared to benzotriazole, in the composition of the present invention provides unexpectedly superior results.

Numerous modifications and variations of the present invention are possible in light of the above teachings and, therefore, within the scope of the appended claims, the invention may be practised otherwise than as particularly described.

I claim:

1. A corrosion inhibiting composition, consisting essentially of:
   (a) at least one water soluble phosphonic acid or water soluble salt thereof;
   (b) at least one member selected from the group consisting of water soluble acrylic acid polymers, water soluble methacrylic acid polymers and water soluble polymers of maleic acid or its anhydride; and
   (c) tolyltriazole, said components (a), (b) and (c), being present in an amount effective to inhibit corrosion in aqueous systems, and wherein the composition includes from 65 to 80% of (a), from 5% to 20% of (b) and from 15% to 25% of (c), based on the three components, all by weight.

2. The composition of claim 1 wherein component (a) is an amino methylene phosphonic acid or salt thereof.

3. The composition of claim 2 wherein the polymer is a homopolymer of maleic acid or its anhydride.

4. The composition of Composition of claim 1 wherein component (a) is selected from the group consisting of ethane-1-hydroxy-1, 1-diphosphonic acid, amino tri (methylene)phosphonic acid, ethylene diamine tetra (methylene phosphonic acid), hexamethylene diamine tetra (methylene phosphonic acid) and water soluble salts thereof.

5. The composition of claim 4 wherein (b) is a homopolymer of maleic acid or its anhydride.

6. The composition of claim 5 wherein component (b) is ethane-1-hydroxy-1, 1-diphosphonic acid or water soluble salt thereof.

7. A process for inhibiting corrosion in an aqueous system, comprising:
   dissolving in the aqueous system a corrosion inhibiting amount of corrosion inhibiting components consisting essentially of:
   (a) at least one water soluble phosphonic acid or water soluble salt thereof;
   (b) at least one member selected from the group consisting of water soluble polymers of acrylic acid, water soluble polymers of methacrylic acid and water soluble polymers of maleic acid or its anhydride; and (c) tolyltriazole.

8. The process of claim 7 wherein the corrosion inhibiting is in an aqueous system in contact with ferrous surfaces.

9. The process of claim 8 wherein component (a) is an amino methylene phosphonic acid or salt thereof.

10. The process of claim 9 wherein the polymer is a homopolymer of maleic acid or its anhydride.

11. The process of claim 7 wherein (a) is present in an amount of from 65% to 80%, (b) from 5% to 20% and (c) from 15% to 25%, based on the three components and all by weight.

12. The process of claim 11 wherein components (a), (b) and (c) are employed in a total concentration of at least 1 ppm.

13. The process of claim 12 wherein component (a) is selected from the group consisting of ethane-1-hydroxy-1, 1-diphosphonic acid, amino tri (methylene) phosphonic acid, ethylene diamine tetra (methylene phosphonic acid), hexamethylene diamine tetra (methylene phosphonic acid) and water soluble salts thereof.

14. The process of claim 13 wherein (b) is a homopolymer of maleic acid or its anhydride.

15. The process of claim 14 wherein component (b) is ethane-1-hydroxy-1, 1-diphosphonic acid or water soluble salt thereof.

* * * * *